US009180492B2

(12) United States Patent
Zhang et al.

(10) Patent No.: US 9,180,492 B2
(45) Date of Patent: Nov. 10, 2015

(54) SCREENING MACHINE FOR SUPERFINE POWDER

(71) Applicant: HENAN KANGXING PHARMACEUTICAL CO., LTD., Zhengzhou (CN)

(72) Inventors: Guozu Zhang, Zhengzhou (CN); Xianzhong Chen, Zhengzhou (CN); Rui Yu, Zhengzhou (CN); Kezhong Li, Zhengzhou (CN); Weiwei Wang, Zhengzhou (CN); Ruyu Chen, Zhengzhou (CN); Haifeng Wei, Zhengzhou (CN)

(73) Assignee: HENAN KANGXING PHARMACEUTICAL CO., LTD., Zhengzhou (CN)

( * ) Notice: Subject to any disclaimer, the term of this patent is extended or adjusted under 35 U.S.C. 154(b) by 72 days.

(21) Appl. No.: 13/846,878

(22) Filed: Mar. 18, 2013

(65) Prior Publication Data

US 2013/0206650 A1 Aug. 15, 2013

Related U.S. Application Data

(63) Continuation-in-part of application No. PCT/CN2012/000646, filed on May 14, 2012.

(30) Foreign Application Priority Data

Nov. 28, 2011 (CN) ..... 2011 1 0382970

(51) Int. Cl.

| | |
|---|---|
| ***B04B 5/10*** | (2006.01) |
| ***B07B 1/00*** | (2006.01) |
| ***B07B 1/18*** | (2006.01) |
| ***B07B 1/55*** | (2006.01) |
| ***B07B 7/06*** | (2006.01) |

(52) U.S. Cl.
CPC ... *B07B 1/00* (2013.01); *B07B 1/18* (2013.01); *B07B 1/55* (2013.01); *B07B 7/06* (2013.01)

(58) Field of Classification Search
CPC ..... B07B 1/00; B07B 1/18; B07B 1/55; B07B 7/06; B07B 7/08; B07B 7/083; B07B 7/10
USPC ..... 209/138, 139.1, 139.2, 143, 154, 710, 209/717, 718, 722, 305, 306
See application file for complete search history.

(56) References Cited

U.S. PATENT DOCUMENTS

| | | | | |
|---|---|---|---|---|
| 3,511,373 | A * | 5/1970 | Westfall et al. | 209/234 |
| 4,260,478 | A * | 4/1981 | Hosokawa et al. | 209/139.2 |
| 7,424,956 | B2 * | 9/2008 | Kohno | 209/721 |

* cited by examiner

*Primary Examiner* — Stefanos Karmis
*Assistant Examiner* — Kalyanavenkateshware Kumar
(74) *Attorney, Agent, or Firm* — Matthias Scholl P.C.; Matthias Scholl

(57) ABSTRACT

A screening machine for superfine powder. The screening machine includes a casing, a screen drum, a funnel, a negative pressure chamber, a rotary air spray pipe, a drive motor, a blast pipe, and a feed pipe. The screen drum is disposed in the middle part of the inner cavity of the casing. The funnel is disposed beneath the casing. The opening of the screen drum is arranged on the bottom of the screen drum and communicates with the upper opening of the funnel. The inner cavity of the casing communicates with the external induced draft fan via the negative pressure chamber disposed on the upper part of the casing. The rotary air spray pipe is arranged in the space between the screen drum and the casing. The middle part of the transverse pipe is connected via a transmission with the drive motor.

7 Claims, 5 Drawing Sheets

SCREENING MACHINE FOR SUPERFINE POWDER

CROSS-REFERENCE TO RELATED APPLICATIONS

This application is a continuation-in-part of International Patent Application No. PCT/CN2012/000646 with an international filing date of May 14, 2012, designating the United States, and further claims priority benefits to Chinese Patent Application No. 201110382970.9 filed Nov. 28, 2011. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The invention relates to a screening machine for superfine powder, and more particularly to a screening machine having bi-directional airflow for superfine powder.

2. Description of the Related Art

Powder technology is one of the most important basic technologies in high and new technology industries and pharmaceutical industries in recent years. The superfine-treatment of powder changes a lot of the original properties of material, thus the application range of traditional materials is extended, and the application value of products is promoted. Therefore, improving the powder classification technology is of great importance. The powder separation and classification equipment is developing rapidly in recent years, and currently, there are two main commonly-used types: classification with a mesh screen, and classification without a mesh screen. The air screening method is a more advanced classification method, and the biggest advantage of an air screening machine is using a screen mesh for effective separation under the impact of air carried with powder, however, the shortage is that the micron-size materials with light weight and small particle size are accumulated on the mesh screen during classification to form caking to block the mesh screen, thus the screening operation cannot be performed. Although the conventional micron-size powder material air screening device adopts the principle of circulating dual airflow, the middle part of the mesh screen is easily blocked due to the uneven reverse airflow, the area of the mesh screen is small under the same volume, the air screening device is not suitable for large-scale production, and meanwhile, the air screening device is complicated in structure and high in energy consumption. At present, the commonly-used turbine classifier is mainly suitable for the materials with monomer component, for example, the large-scale production of mineral superfine powder, however, it's not suitable for the mixed powder with complicated component, for example, the screening production of plant superfine powder with high difference in specific gravity of various components, because the maximum particle size is not easy to be controlled accurately.

SUMMARY OF THE INVENTION

In view of the above-described problems, it is one objective of the invention to provide a screening machine for superfine powder that is advantageous in high screening efficiency, large effective area of a screen mesh, long service life, convenience in replacement of the screen mesh, simple structure of equipment, and low energy consumption, and is suitable for industrial production.

To achieve the above objective, in accordance with one embodiment of the invention, there is provided a screening machine for superfine powder, comprising: a casing, the casing comprising an inner cavity; a screen drum, the screen drum comprising an opening; a funnel, the funnel comprising: a sidewall, and an upper opening; a negative pressure chamber; a rotary air spray pipe, the rotary air spray pipe comprising: a transverse pipe, and a vertical pipe; a drive motor; a blast pipe, the blast pipe comprising: an air inlet, and an air outlet; and a feed pipe, the feed pipe comprising: a feed inlet, and a feed outlet. The screen drum is disposed in a middle part of the inner cavity of the casing. The funnel is disposed beneath the casing. The opening of the screen drum is arranged on a bottom of the screen drum and is communicated with the upper opening of the funnel. The inner cavity of the casing is communicated with an external induced draft fan via the negative pressure chamber disposed on an upper part of the casing. The rotary air spray pipe is arranged in a space between the screen drum and the casing. The rotary air spray pipe is substantially in the shape of a Chinese character "men" having the meaning of "door." A middle part of the transverse pipe is connected via a transmission with the drive motor. The blast pipe is arranged vertically in a middle part of the screen drum. The air outlet of the blast pipe passes through the screen drum and is connected to the middle part of the transverse pipe of the rotary air spray pipe. The air outlet of the blast pipe is in rolling connection with the transverse pipe via a rolling bearing. The air inlet of the blast pipe stenches outside the sidewall of the funnel and is communicated to a blast orifice of an external blast blower. The feed pipe is arranged inside the screen drum. The feed outlet of the feed pipe is arranged beneath a buffering umbrella. The feed outlet of the feed pipe stretches outside the sidewall of the funnel.

In a class of this embodiment, air jet holes of the rotary air spray pipes are formed by axially arranging grooves on pipe walls of the transverse pipe and the vertical pipe, respectively. An opening of each groove is arranged facing the screen drum.

In a class of this embodiment, air jet holes of the rotary air spray pipes are formed by axially arranging a plurality of strip holes on pipe walls of the transverse pipes and the vertical pipes at intervals, respectively. An opening of each of the strip holes is arranged facing the screen drum.

In a class of this embodiment, two rotary air spray pipes are provided and arranged in the space between the screen drum and the casing; and the transverse pipes of the two rotary air spray pipes are mutually crossed and perpendicular.

Advantages of the Invention are Summarized as Follows:

1. During the powder screening process, air classification and classification with a mesh screen are carried out at the same time, and due to the arrangement of the rotary air spray pipes outside a screen drum, uniform airflow blowing into the screen drum is generated on the outer peripheral surface of the screen drum, thus the phenomenon that the micron-size materials with light weight and small particle size are accumulated on a mesh screen to form caking to block screen openings is avoided, and the powder classification efficiency is improved greatly; therefore, the technical guarantee is provided for the superfine-treatment (the particle size of the powder after superfine-treatment is equal to or smaller than 25 microns) of powder, and the large-scale industrial production is realized for the operation of screening the superfine powder (above 500-mesh).

2. By adopting the structural design of the screening machine, a screen drum structure can be selected for a screening component, and the screening area of the screen drum is bigger than that of the screen plate under the condition of given volume of the screening device, thus the screening efficiency is improved.
3. The materials are sieved under the guidance of airflow from the induced draft fan, and the air-drying effect of materials is generated during the screening process, thus the external drying apparatus is saved, and the energy consumption is reduced.
4. The screening machine has a simple structure, is convenient for the screen drum to replace, and easy to repair and maintain.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a screening machine for superfine powder are described below. It should be noted that the following examples are intended to describe and not to limit the invention.

Figure 1:
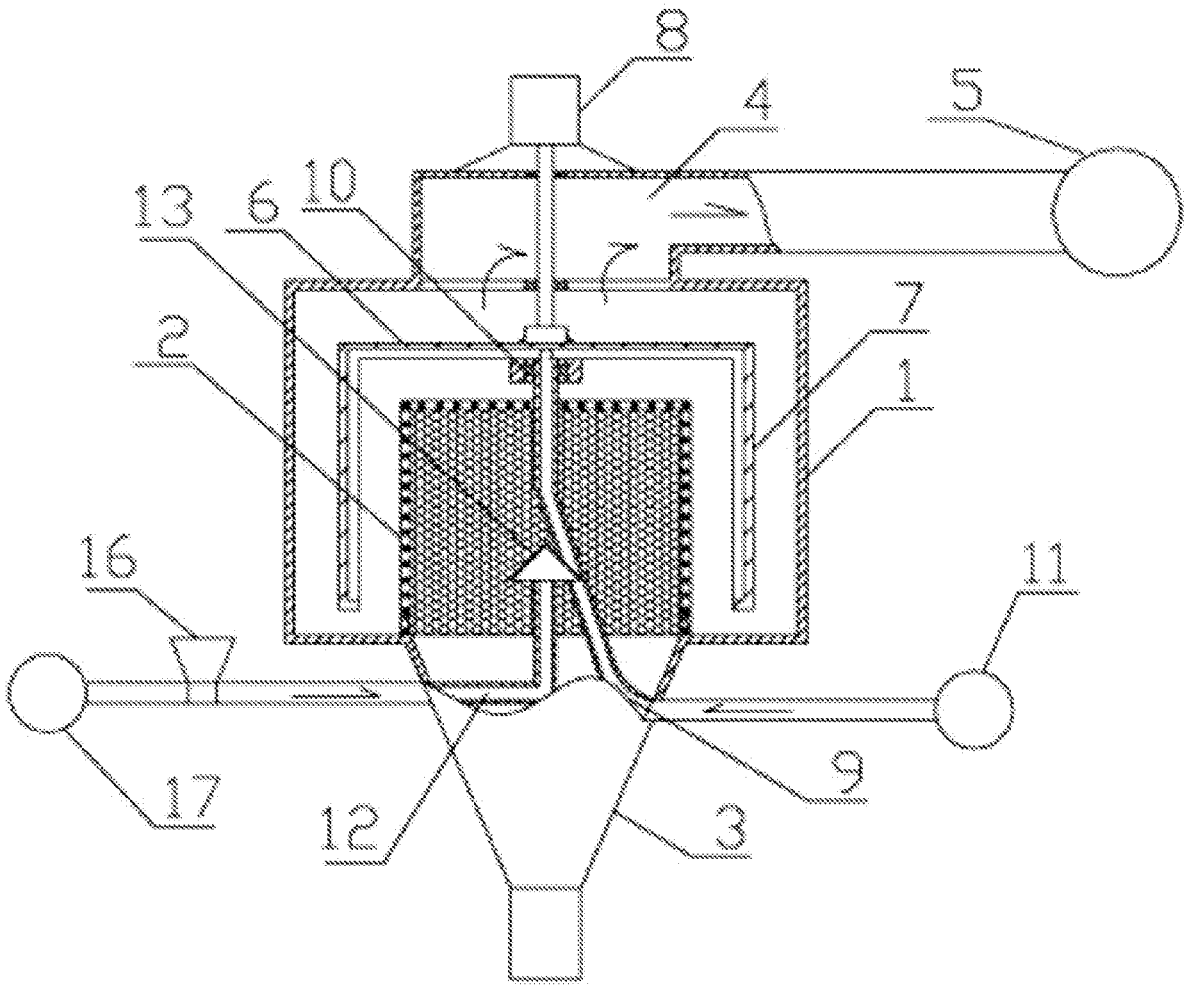
FIG. 1 is a structure diagram of a bidirectional superfine powder air screening machine in accordance with one embodiment of the invention.

As shown in FIG. 1, a screening machine for superfine powder comprises a casing 1. A screen drum 2 comprising an opening downward is arranged in a middle part of an inner cavity of the casing 1, and the opening of the screen drum 2 is communicated with an upper opening of a funnel 3, and the funnel is arranged beneath the casing 1. The inner cavity of the casing 1 is communicated with an external induced draft fan 5 via a negative-pressure room 4 arranged on an upper part. Two rotary air spray pipes rotary air spray pipes substantially in the shape of a Chinese character "men" are arranged in a space between the screen drum 2 and the casing 1. Each rotary air spray pipe comprises: a transverse pipe 6, and a vertical pipe 7. The transverse pipes 6 of the two rotary air spray pipes are mutually crossed and perpendicular, mutually communicated and fixed. A middle of each transverse pipe 6 of the rotary air spray pipe is connected via a transmission with a driving motor 8. A blast pipe 9 is vertically arranged in a middle part of the screen drum 2. An air outlet of the blast pipe 9 passes through the screen drum 2 to be communicated with the middle of the transverse pipe 6 of the rotary air spray pipe, and is in rolling connection with the transverse pipe 6 of the rotary air spray pipe via a rolling bearing 10. An air inlet of the blast pipe 9 extends out of a sidewall of the funnel 3 and is communicated with a blast orifice of a blast blower 11. A feed pipe 12 is arranged inside the screen drum 2. A buffer umbrella 13 is arranged above a feed outlet of the feed pipe 12. A feed inlet of the feed pipe 12 extends out of the sidewall of the funnel 3 and is communicated with an air outlet of a powder conveying blower 17 through an airlock 16.

Figure 2:
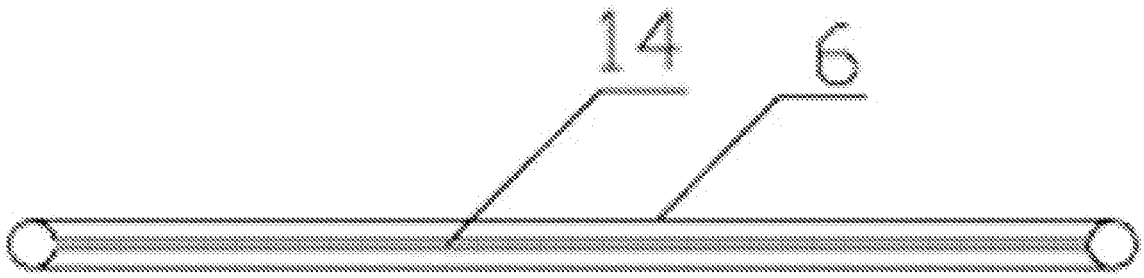
FIG. 2 is a structure diagram of an air jet hole of a transverse pipe of a the rotary air spray pipe being a structure of a groove in accordance with one embodiment of the invention.
Figure 3:
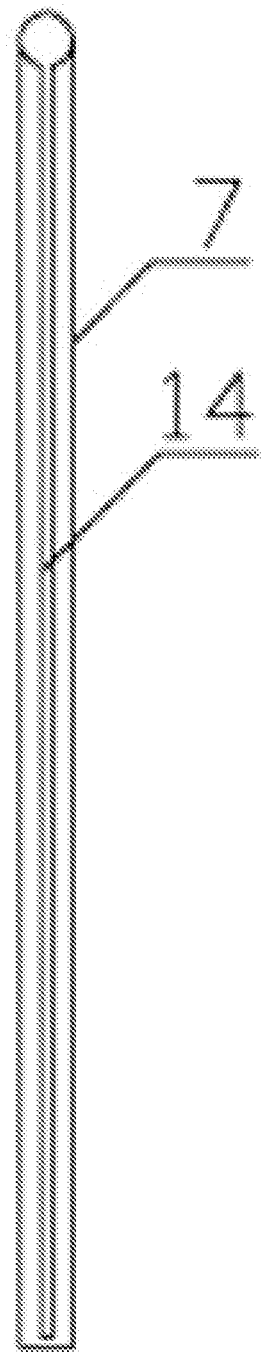
FIG. 3 is a structure diagram of an air jet hole of a vertical pipe of a the rotary air spray pipe being a structure of a groove in accordance with one embodiment of the invention.

As shown in FIG. 2 and FIG. 3, grooves are axially arranged on pipe walls of the transverse pipe 6 and the vertical pipes 7, respectively, to form air jet holes. An opening of each groove is arranged facing the screen drum 2. A width of the groove 14 is 0.5-2 mm.

Figure 4:
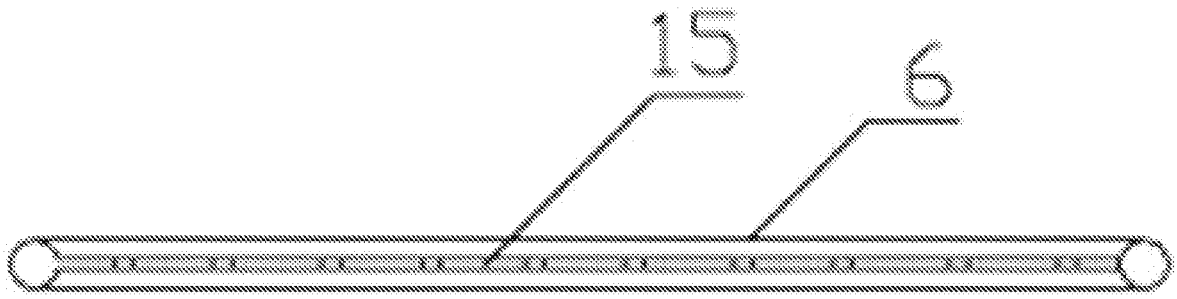
FIG. 4 is a structure diagram of an air jet hole of a transverse pipe of a rotary air spray pipe being a structure of strip holes in accordance with one embodiment of the invention.
Figure 5:
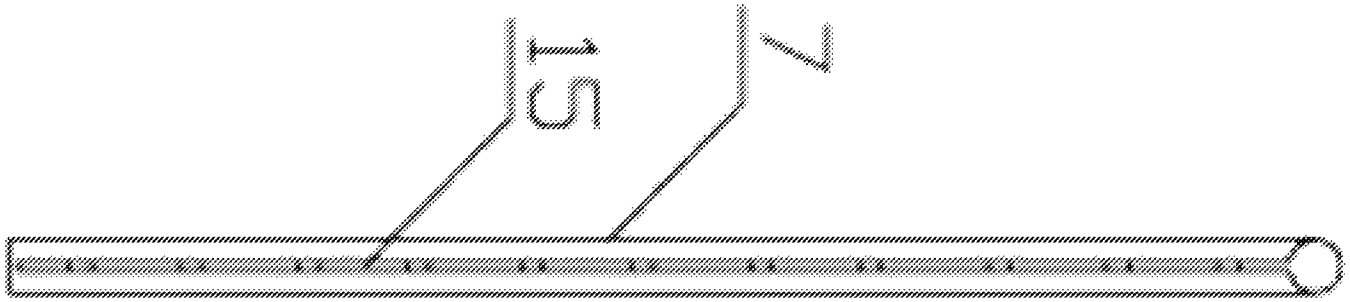
FIG. 5 is a structural diagram of an air jet hole of a vertical pipe of a rotary air spray pipe being a structure of strip holes in accordance with one embodiment of the invention.

As shown in FIG. 4 and FIG. 5, air jet holes of the rotary air spray pipes is formed by axially arranging a plurality of strip holes 15 on the pipe walls of the transverse pipes 6 and the vertical pipes 7 at intervals, respectively. Openings of the strip holes 15 are arranged facing the screen drum 2.

Two rotary air spray pipes are provided and arranged in the space between the screen drum 2 and the casing 1. The transverse pipes 6 of the two rotary air spray pipes are mutually crossed and perpendicular.

Working principle of the invention is as follows:

As shown in FIGS. 1-5, during the working process, the powder conveying blower 17, the induced draft fan 5 and the driving motor 8 are started first. The blowing pressure of the powder conveying blower 17 is 24 kPa, and the amount of blowing air is 150 $m^3/h$; the induced draft pressure of the induced draft fan 5 is 1000 Pa, and the amount of induced air is 3000 $m^3/h$; the blast pressure of the blast blower 11 is 33 kPa, and the blast volume is 320 $m^3/h$; the rotational speed of the driving motor 8 is 155 revolutions per minute.

1. The powder to be classified is carried into the screen drum 2 under the action of high-speed air flow of the powder conveying blower 17 after passing through the airlock 16 and the feed pipe 12, the impact force is reduced by the buffering umbrella 13. The powder to be classified is dispersed in the screen drum 2. The screen drum 2 adopts a 500-mesh mesh screen.

2. The powder dispersed in the screen drum 2 is classified in the screen drum 2 in the presence of the induced draft fan 5. Fine powder being capable of passing through the screen drum 2 is collected by the negative-pressure room 4 due to the negative pressure. Coarse powder which fails to pass through the screen drum 2 deposits and is collected at the feed outlet of the funnel 3.

3. The rotary air spray pipes are driven to rotate by the driving motor 8, the air output from the blast blower 11 enters the transverse pipes 6 and the vertical pipes 7 through the blast pipe 9, and then passes through the air jet holes in structures of through grooves 14 formed on the pipe walls of the transverse pipes 6 and the vertical pipes 7. Thus, a reverse blowing air is formed uniformly blowing into the screen drum from a top surface and a side surface of the screen drum 2. The powder in the screen drum 2 is further atomized. Meanwhile, the powder is prevented from caking on the screen drum 2 to further block the mesh screen; and the coarse powder which fails to pass through the screen drum 2 deposits along with the formed air eddy and enters the funnel 3 to be discharged and collected. Distances from the transverse pipes 6 to the top wall and from the vertical pipes 7 to the sidewall of the screen drum 2 are 25 mm, respectively.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A screening machine for superfine powder, the screening machine comprising:

a) a casing, the casing comprising an inner cavity;

b) a screen drum, the screen drum comprising an opening, a top cover, and a cylindrical sidewall;

c) a funnel, the funnel comprising: a sidewall, and an upper opening;

d) a negative pressure chamber;

e) a rotary air spray pipe, the rotary air spray pipe comprising: a transverse pipe, a first vertical pipe, a second vertical pipe, and air jet holes; the air jet holes comprising a first aperture, a second aperture, and a third aperture; and the transverse pipe comprising a first terminal and a second terminal;

f) a drive motor;

g) a blast pipe, the blast pipe comprising: an air inlet, and an air outlet;

h) a feed pipe, the feed pipe comprising: a feed inlet, and a feed outlet; and i) an external induced draft fan;

wherein the screen drum is disposed in a middle part of the inner cavity of the casing;

the funnel is disposed beneath the casing;

the opening of the screen drum is arranged on a bottom of the screen drum and communicates with the upper opening of the funnel;

the inner cavity of the casing communicates with the external induced draft fan via the negative pressure chamber disposed on an upper part of the casing;

the rotary air spray pipe is arranged in a space between the screen drum and the casing;

a middle part of the transverse pipe is connected via a transmission with the drive motor;

the first vertical pipe is connected to the first terminal and is arranged perpendicular to the transverse pipe;

the second vertical pipe is connected to the second terminal and is arranged perpendicular to the transverse pipe;

the transverse pipe is arranged parallel to the top cover;

the first vertical pipe is arranged parallel to the cylindrical sidewall;

the second vertical pipe is arranged parallel to the cylindrical sidewall;

the first aperture is longitudinally disposed along the transverse pipe and is arranged facing the top cover;

the second aperture is longitudinally disposed along the first vertical pipe and is arranged facing the cylindrical sidewall;

the third aperture is longitudinally disposed along the second vertical pipe and is arranged facing the cylindrical sidewall;

the blast pipe is arranged vertically in a middle part of the screen drum;

the air outlet of the blast pipe passes through the screen drum and is connected to the middle part of the transverse pipe of the rotary air spray pipe;

the air outlet of the blast pipe is in rolling connection with the transverse pipe via a rolling bearing;

the air inlet of the blast pipe stretches outside the sidewall of the funnel and communicates to an blast orifice of an external blast blower;

the feed pipe is arranged inside the screen drum;

the feed outlet of the feed pipe is arranged beneath a buffering umbrella; and the feed outlet of the feed pipe stretches outside the sidewall of the funnel.

2. The screening machine of claim 1, wherein the first aperture has a width of 0.5-2 mm;

the second aperture has a width of 0.5-2 mm; and the third aperture has a width of 0.5-2 mm.

3. The screening machine of claim 1, wherein two rotary air spray pipes are provided and arranged in the space between the screen drum and the casing; and the transverse pipes of the two rotary air spray pipes are mutually crossed and perpendicular.

4. The screening machine of claim 2, wherein two rotary air spray pipes are provided and arranged in the space between the screen drum and the casing; and the transverse pipes of the two rotary air spray pipes are mutually crossed and perpendicular.

5. The screening machine of claim 1, wherein the top cover comprises a plurality of screening apertures.

6. The screening machine of claim 1, wherein the first aperture extends over a diameter of the screen drum;

the second aperture extends over a height of the screen drum; and the third aperture extends over the height of the screen drum.

7. The screening machine of claim 1, wherein when in use, the rotatory air spray pipe is driven by the drive motor and rotates about the screen drum;

the screen drum remains stationary relative to the casing; and the external induced draft fan extracts air from the negative pressure chamber.

* * * * *